US005493480A

United States Patent [19]

Huang

[11] Patent Number: 5,493,480

[45] Date of Patent: Feb. 20, 1996

[54] ILLUMINATED UMBRELLA

[76] Inventor: Tien-Tsai Huang, No. 4, Lane 30, Wu-Chang St., Pan-Chiao City, Taiwan

[21] Appl. No.: 288,934

[22] Filed: Aug. 10, 1994

[51] Int. Cl.[6] ..... A45B 3/02

[52] U.S. Cl. ..... 362/102; 362/32; 135/910

[58] Field of Search ..... 362/32, 102, 157; 135/16, 910

[56] References Cited

U.S. PATENT DOCUMENTS

| | | | |
|---|---|---|---|
| 781,433 | 1/1905 | Kortenbach et al. . | |
| 1,096,216 | 5/1914 | Beehler . | |
| 1,595,023 | 8/1926 | Probe . | |
| 2,372,471 | 3/1945 | Campbell | 362/102 |
| 2,435,650 | 2/1948 | Greene | 240/6.42 |
| 3,281,586 | 10/1966 | Gonzalez | 240/6.42 |
| 4,099,535 | 7/1978 | Hubachek | 135/66 |
| 4,236,544 | 12/1980 | Osaka | 135/66 |
| 4,544,990 | 10/1985 | Wieselman et al. | 362/32 |
| 4,848,385 | 7/1989 | Pennella | 135/16 |

FOREIGN PATENT DOCUMENTS

| | | | |
|---|---|---|---|
| 680200 | 4/1966 | Belgium . | |
| 2606046 | 8/1977 | Germany . | |
| 2655215 | 6/1978 | Germany . | |
| 269832 | 4/1927 | United Kingdom . | |
| 1270457 | 4/1972 | United Kingdom . | |
| 9006069 | 6/1990 | WIPO | 362/102 |

*Primary Examiner*—Ira S. Lazarus
*Assistant Examiner*—Sara Sachie Raab
*Attorney, Agent, or Firm*—Baker & Botts

[57] ABSTRACT

An illuminated umbrella includes a shank with upper and lower end portions, a plurality of ribs connected pivotably to the upper end portion of the shank at one end thereof, a slidable ring member sleeved on the shank, and a plurality of spreaders which are connected pivotally to a periphery of the ring member at one end and which are connected pivotally and respectively to the ribs at the other end. A hollow telescopic tube is made of a material that permits passage of light therethrough. The hollow telescopic tube is sleeved on the shank and has a first end portion secured to the slidable ring member and a second end portion connected securely to the lower end portion of the shank. A light generating unit is mounted on the lower end portion of the shank and is activable so as to emit and project light into the hollow telescopic tube via the second end portion of the tube.

2 Claims, 6 Drawing Sheets

ILLUMINATED UMBRELLA

BACKGROUND OF THE INVENTION

1. Field of the Invention

This invention relates to an umbrella, more particularly to an illuminated umbrella.

2. Description of the Related Art

Presently, there are many kinds of illuminated umbrellas available in the market. However, these conventional illuminated umbrellas require substantial modifications in the basic structure of a conventional umbrella, thereby resulting in a complicated and relatively expensive manufacturing process.

SUMMARY OF THE INVENTION

Therefore, the main objective of the present invention is to provide an illuminated umbrella which does not require substantial modifications in the basic structure of the conventional umbrella so as to simplify the manufacture thereof and so as to lower the manufacturing cost of the same.

According to the present invention, an illuminated umbrella includes a shank with upper and lower end portions, a plurality of ribs which are connected pivotably to the upper end portion of the shank at one end thereof, a slidable ring member which is sleeved on the shank, and a plurality of spreaders which are connected pivotally to a periphery of the ring member at one end and which are connected pivotally and respectively to the ribs at the other end. A hollow telescopic tube is made of a material that permits passage of light therethrough. The hollow telescopic tube is sleeved on the shank and has a first end portion secured to the slidable ring member and a second end portion connected securely to the lower end portion of the shank. A light generating unit is mounted on the lower end portion of the shank and is activable so as to emit and project light into the hollow telescopic tube via the second end portion of the tube.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
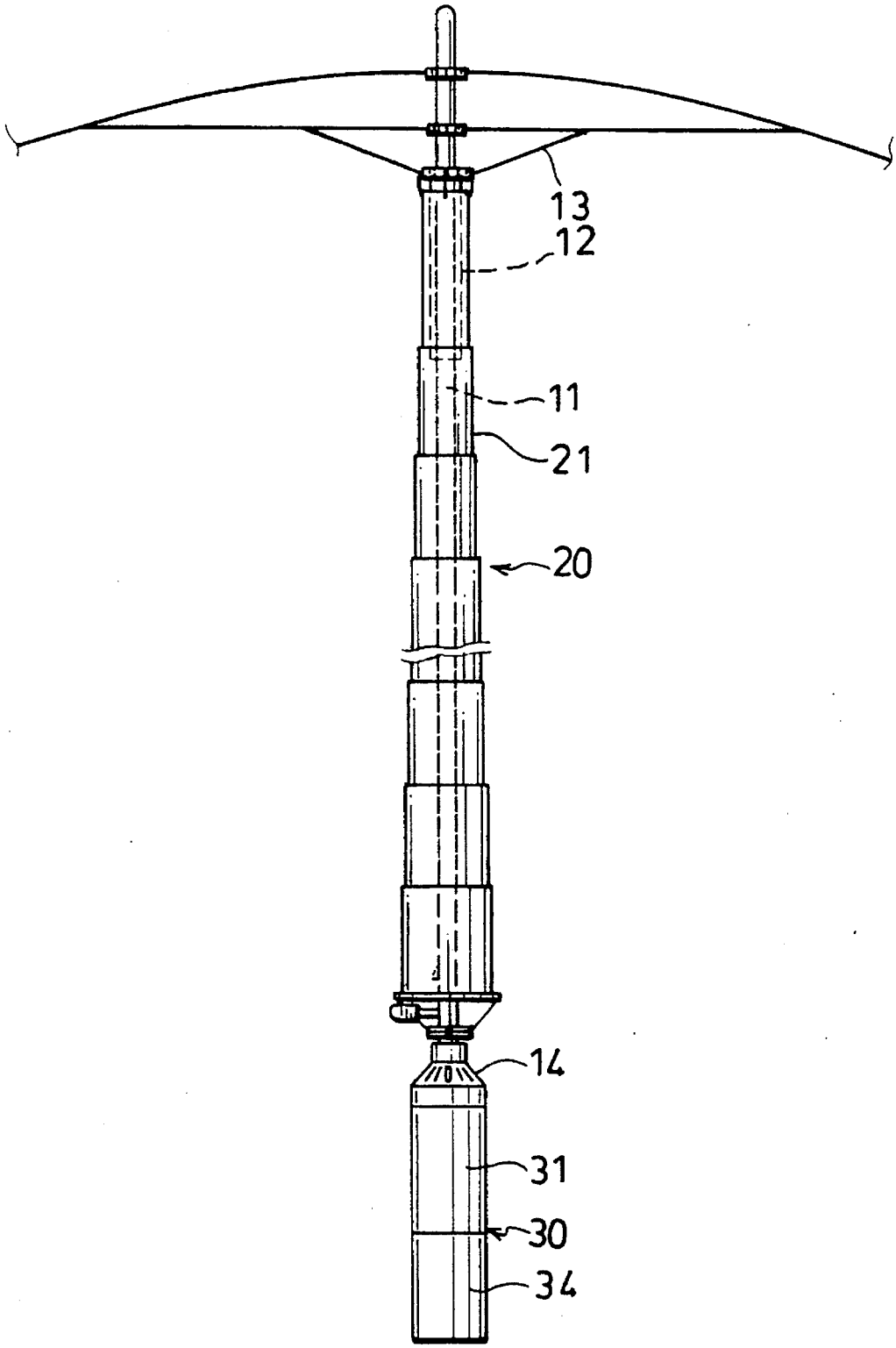
FIG. 1 is a schematic view showing an illuminated umbrella according to the present invention when a slidable ring member umbrella is in a first position.
Figure 2:
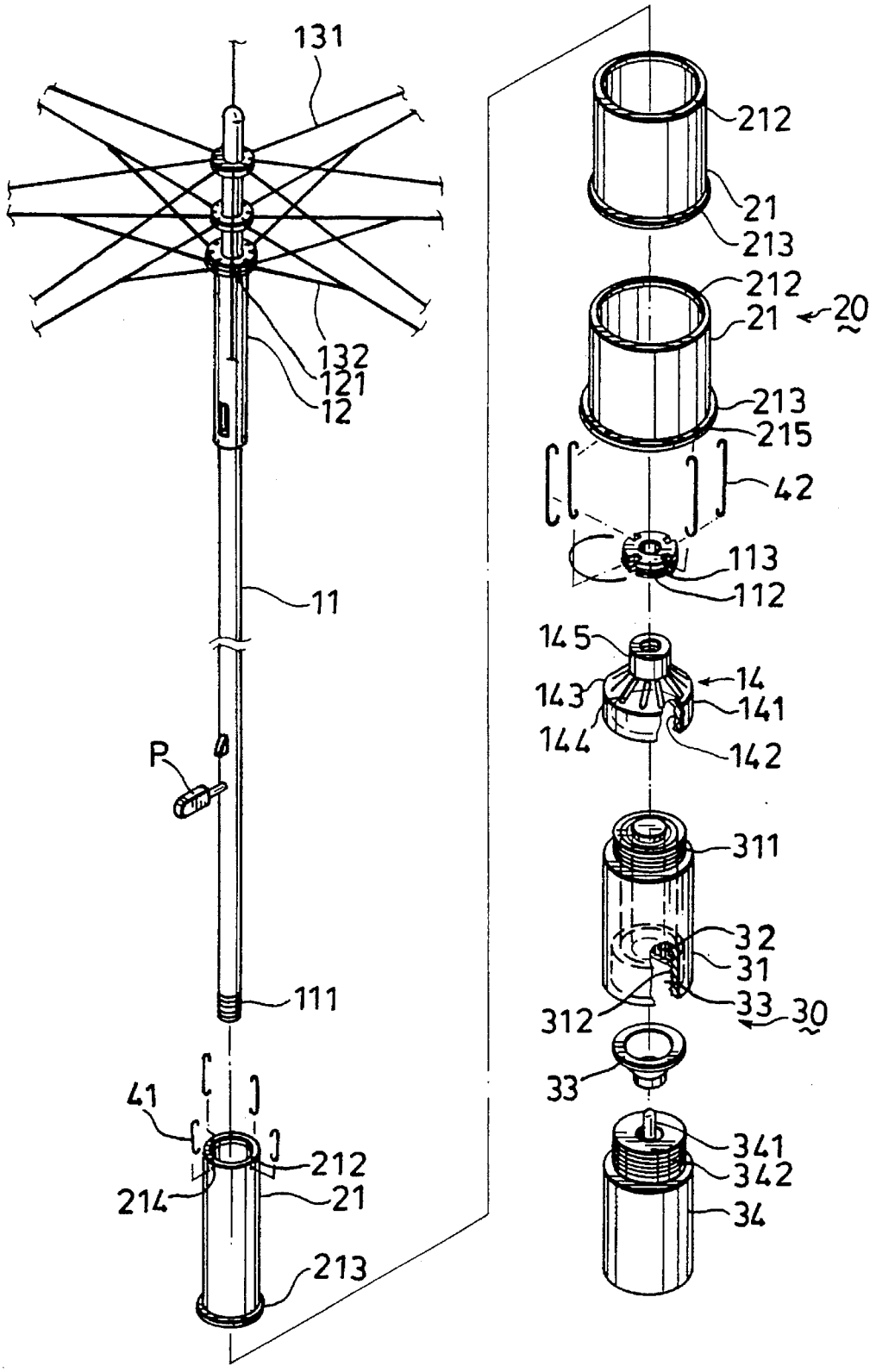
FIG. 2 is an exploded view showing the illuminated umbrella according to the present invention.
Figure 3:
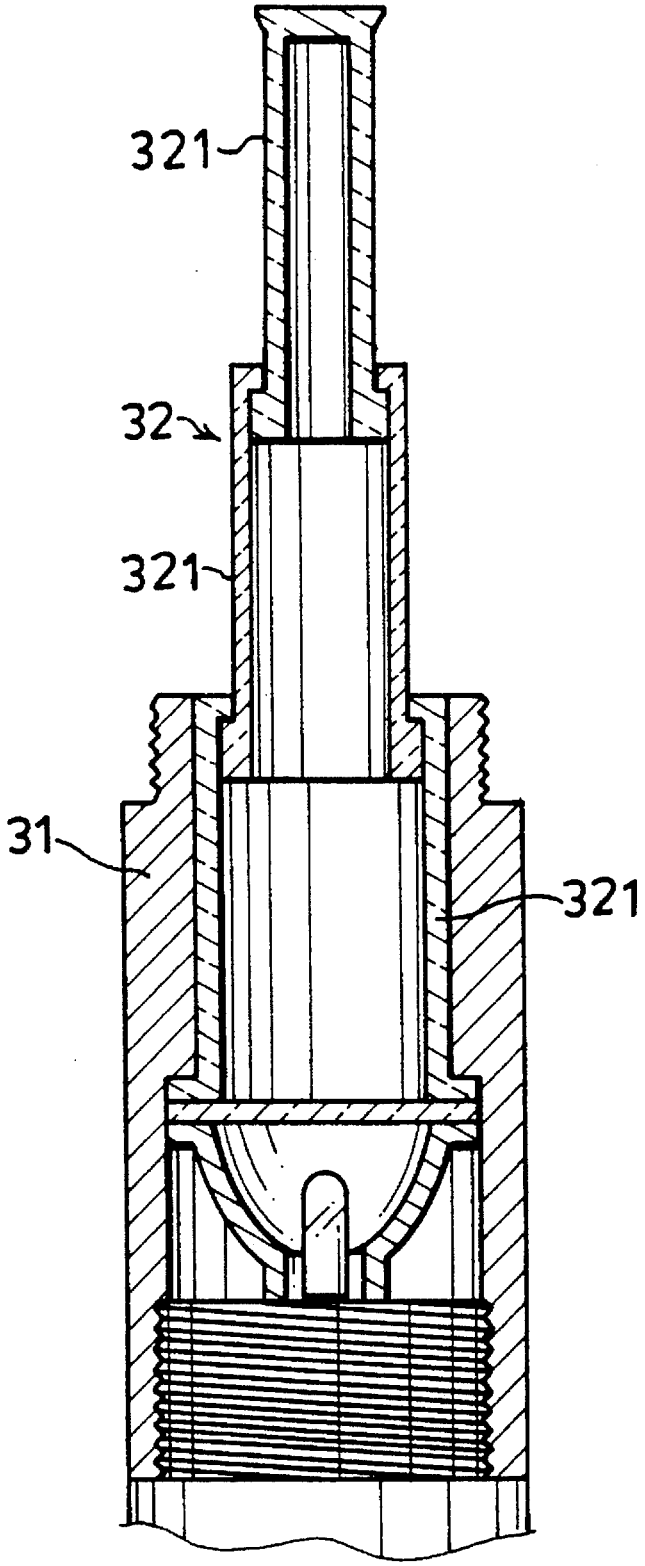
FIG. 3 is an enlarged view showing the relationship between an adapter device and a second hollow telescopic tube unit of the illuminated umbrella according to the present invention.

Referring to FIGS. 1, 2 and 3, an illuminated umbrella according to the present invention includes a shank 11, a plurality of ribs 131, a slidable ring member 12, a plurality of spreaders 132, a hollow handle 14, a hollow telescopic tube 20 and a light generating unit 30.

The shank 11 has an upper end portion and a lower end portion which is formed with external screw threads 111. A fixed ring 112 is sleeved on the lower end portion of the shank 11 and is located adjacent to the external screw threads 111. The fixed ring 112 has a plurality of angularly spaced radial holes 113 formed in a peripheral wall thereof.

The slidable ring member 12 is sleeved on the shank 11 and has a plurality of angularly spaced radial holes 121 formed in a peripheral wall thereof.

The ribs 131 are connected pivotably to the upper end portion of the shank 11 at one end thereof and cooperatively support a canopy (not shown) thereon in a known manner.

Figure 4:
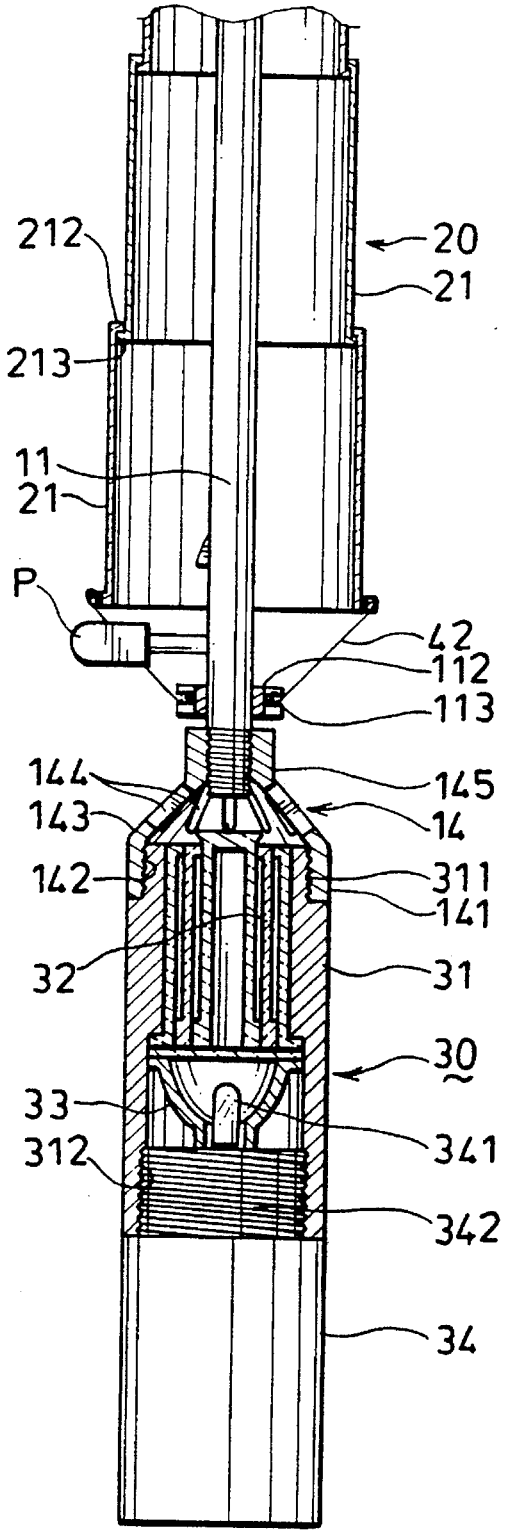
FIG. 4 is a fragmentary view illustrating a part of the illuminated umbrella shown in FIG. 1.

Each of the spreaders 132 has a first end extending into a respective one of the radial holes 121 of the ring member 12 and a second end connected to a respective one of the ribs 131. The ring member 12 is movable between a first position, wherein the ribs 131 form an angle with the shank 11 so as to open the canopy, and a second position, wherein the ribs 131 are adjacent to the shank 11, as shown in FIG. 4.

The hollow handle 14 has a first end portion which has a slotted top wall 143 formed with a plurality of slots 144 and a second end portion 141 which is opposite to the first end portion 145 of the handle 14 and which is formed with internal screw threads 142. An internally threaded stem 145 extends upwardly from the top wall 143 of the handle 14 and is connected threadably to the lower end portion of the shank 11 so as to retain the handle 14 on the shank 11.

The hollow telescopic tube 20 is made of a material that permits the passage of light therethrough. In the present embodiment, the material is a plastic material. The tube 20 is sleeved on the shank 11 and includes a plurality of tube sections 21 of different diameters. Each of the tube sections 21 has a first open end formed with a radial inwardly extending flange 212 and a second open end formed with a radial outwardly extending flange 213. The tube section 21 with the smallest diameter is formed with a plurality of radial holes 214 on the periphery of the first open end. The first open end of the tube section 21 with the smallest diameter serves as a first end portion of the tube 20 and is secured to the ring member 12 by means of a plurality of hook members 41. Each of the hook members 41 has a first hooked end which extends into a respective one of the radial holes 121 of the ring member 12 and a second hooked end which extends into a respective one of the radial holes 214 of the tube section 21 with the smallest diameter. The second open end of the tube section 21 with the largest diameter is formed with a plurality of angularly spaced through-holes 215 in the radial outwardly extending flange 213. The second open end of the tube section 21 with the largest diameter serves as the second end portion of the tube 20 and is secured to the radial holes 113 of the fixed ring 112 on the lower end portion of the shank 11 by means of a plurality of hook members 42 which are similar to the hook members 41 described beforehand. The first hooked end of each of the hook members 42 extends into a respective one of the through-holes 215 of the tube section 21 with the largest diameter. The second hooked end of each of the hook members 42 extends into a respective one of the radial holes 113 of the fixed ring 112. The second open end 213 of each of the remaining tube sections 21 extends into the first open end 212 of the adjacent tube section 21 with the larger diameter. The radial inwardly extending flange 212 of one of the tube sections 21 engages the radial outwardly extending flange 213 of an adjacent one of the tube sections 21 so as to prevent disengagement between adjacent tube sections 21.

The light generating unit 30 is a flashlight unit and includes a housing which comprises a hollow adapter device 31, a second hollow telescopic tube 32 and a barrel 34. The adapter device 31 has an open top end, which is formed with external screw threads 311, and a lower end. The open top end of the adapter device 31 is connected threadably to the second end portion 141 of the handle 14. The second hollow telescopic tube 32 is made of a material that permits the passage of light therethrough and includes a plurality of tube sections 321 of different diameters. In the present embodiment, the second hollow telescopic tube 32 includes three tube sections 32. Since the structure of the second hollow telescopic tube 32 is similar to that of the tube 20, a detailed description of the former will be omitted herein. The second tube 32 is disposed in the adapter device 31 adjacent the open top end of the adapter device 31 and has a lower end portion that is retained in the adapter device 31 and an upper end portion that is extendible from the open top end of the adapter device 31 when the light generating unit 30 is removed from the hollow handle 14. The barrel 34 has a top end which is formed with external screw threads 342 on the periphery thereof and which is connected threadably to the lower end of the adapter device 31. The light generating unit 30 further includes a bulb 341 which is installed on the top end of the barrel 34 and which is extends into the adapter device 31. A reflector 33 is mounted on the top end of the barrel 34 and surrounds the bulb 341 so as to reflect the light emitted by the bulb 341 toward the open top end of the adapter device 31. It should be noted that the actuation of the light generating unit 30 may be achieved by means of a rotary switch (not shown) or a push button (not shown). In the present embodiment, a rotary switch is employed due to its water-resistant characteristics.

In assembly, the hollow telescopic tube 20 is sleeved on the shank 11. The first open end of the tube section 21 with the smallest diameter is secured to the ring member 12 by means of the hook members 41. The second open end of the tube section 21 with the largest diameter is connected securely to the lower end portion of the shank 11 by means of the hook members 42. The stem 145 of the handle 14 is connected threadably to the lower end portion of the shank 11 so as to retain the handle 14 on the shank 11. Lastly, the open top end of the adapter device 31 is connected to the second end portion 141 of the handle 14.

In the present embodiment, the slidable ring member 12 is movable automatically from the second position to the first position when a push button means (P) is actuated. Since the connection between the push button means (P) and the ring member 12 is conventional, a detailed description thereof is thus omitted herein. It should be noted that the ring member 12 may be moved manually from the second position to the first position in a known manner which will not be described further.

As illustrated in FIG. 1, in operation, when the ring member 12 is located in the first position, the hollow telescopic tube 20 is in a stretched state. At this stage, activation of the light generating unit 30 will cause the latter to emit and project light through the slotted top wall of the handle 14 and into the hollow telescopic tube 20 via the second end portion of the tube 20.

Figure 5:
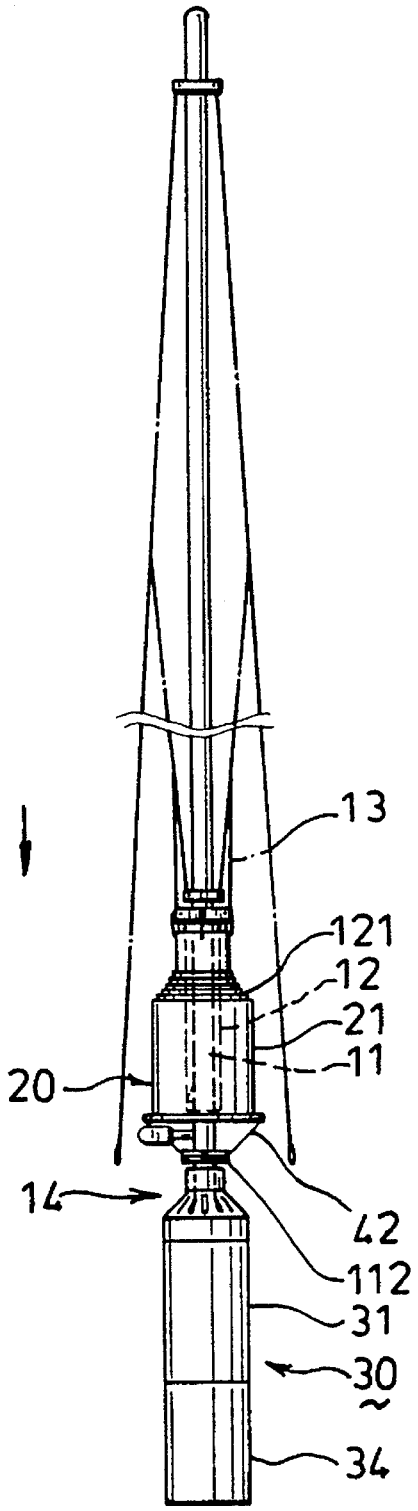
FIG. 5 is a schematic view showing an illuminated umbrella according to the present invention when the slidable ring member is in a second position.
Figure 6:
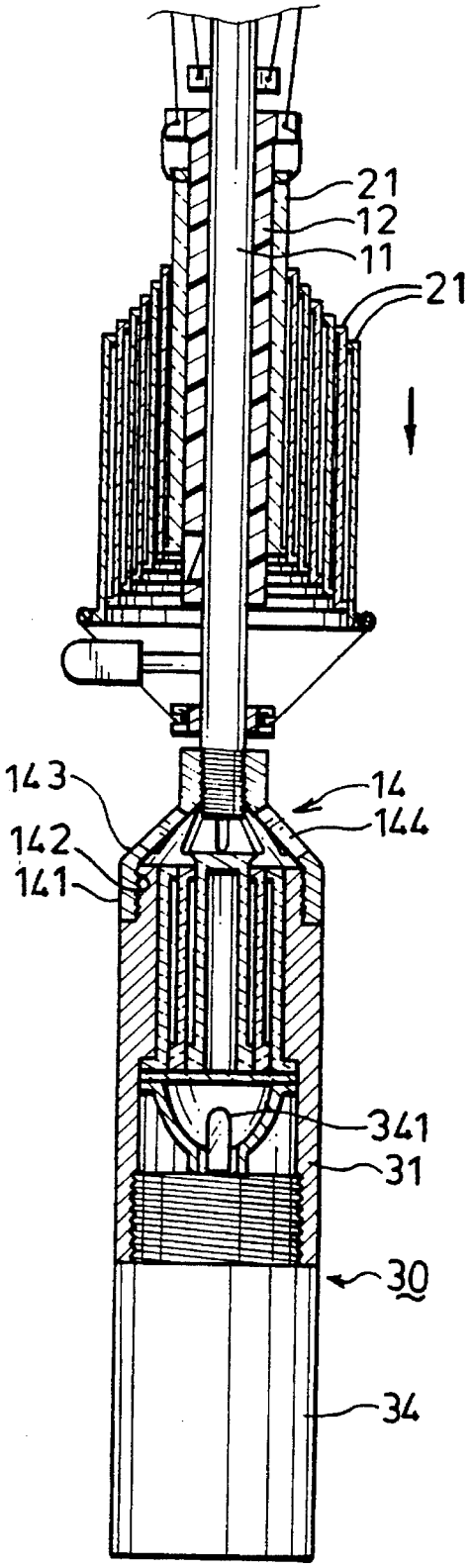
FIG. 6 is a fragmentary view illustrating a part of the illuminated umbrella shown in FIG. 4.

Referring to FIGS. 4 and 5, when the illuminated umbrella according to the present invention is not in use, the tube 20 is retracted as the ring member 12 is moved from the first position to the second position.

Accordingly, the illuminated umbrella of the present invention has the following advantages:

(1). The illuminated umbrella of the present invention does not require substantial modifications in the basic structure of the conventional umbrella, thereby simplifying the manufacture thereof and lowering the manufacturing cost of the same.

(2). The light generating unit 30 can function as an ordinary flashlight unit when removed from the handle 14.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An illuminated umbrella including a shank with upper and lower end portions, a plurality of ribs connected pivotably to said upper end portion of said shank at one end of said ribs, a slidable ring member sleeved on said shank, and a plurality of spreaders, each of said spreaders having first and second ends and being connected pivotally to a periphery of said ring member at said first end and being connected pivotally and respectively to said ribs at said second end, said illuminated umbrella further comprising:

a hollow telescopic robe made of a material that permits passage of light therethrough, said hollow telescopic tube being sleeved on said shank and having a first end portion secured to said slidable ring member and a second end portion connected securely to said lower end portion of said shank;

a light generating unit which is mounted on said lower end portion of said shank and which is capable of being activated so as to emit and project light into said hollow telescopic tube via said second end portion of said tube; and a hollow handle which has a first end portion connected to said lower end portion of said shank and a second end portion opposite to said first end portion, said light generating, unit being a flashlight unit and including a housing with a light transmitting end which is connected removably to said second end portion of said hollow handle said first end portion of said handle having a slotted top wall which permits passage of light emitted and projected by said light generating unit into said hollow telescopic tube.

2. An illuminated umbrella as claimed in claim 1, wherein said housing of said light generating unit comprising a hollow adapter device which has a lower end and an open top end that serves as said light transmitting end of said housing and that is connected removably to said second end portion of said hollow handle, a second hollow telescopic tube which is disposed in said adapter device adjacent said open top end of said adapter device and which has a lower end portion retained in said adapter device and an upper end portion extendible from said open top end of said adapter device when said light generating unit is removed from said hollow handle, and a barrel which has a top end connected to said lower end of said adapter device, said light generating unit further comprising a bulb which is installed on said top end of said barrel and which extends into said adapter device, and a reflector which is mounted on said top end of said barrel and which surrounds said bulb so as to reflect light emitted by said bulb toward said open top end of said adapter device, said second hollow telescopic robe being made of a material that permits passage of light therethrough.

* * * * *